US008368605B1

(12) United States Patent
Tam

(10) Patent No.: US 8,368,605 B1
(45) Date of Patent: Feb. 5, 2013

(54) ELECTROLYTIC FLUID ANTENNA WITH SIGNAL ENHANCER

(75) Inventor: Daniel W. S. Tam, San Diego, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 847 days.

(21) Appl. No.: 12/539,834

(22) Filed: Aug. 12, 2009

(51) Int. Cl.
*H01Q 1/34* (2006.01)
*H01Q 1/26* (2006.01)
*H01Q 7/08* (2006.01)

(52) U.S. Cl. ..... 343/709; 343/701; 343/788

(58) Field of Classification Search ..... 343/709, 343/701, 786, 788
See application file for complete search history.

(56) References Cited

U.S. PATENT DOCUMENTS

| | | | | |
|---|---|---|---|---|
| 4,498,086 | A | 2/1985 | Sandler | |
| 5,633,648 | A | 5/1997 | Fischer | |
| 5,886,661 | A * | 3/1999 | Harrison et al. | 342/22 |
| 6,492,956 | B1 | 12/2002 | Fischer et al. | |
| 6,674,970 | B1 | 1/2004 | Anderson | |
| 7,262,734 | B2 | 8/2007 | Wood | |
| 7,969,370 | B1 * | 6/2011 | Dinh et al. | 343/720 |

OTHER PUBLICATIONS

David H. Hatch; The "ILA"—Ionic Liquid Antenna Concept by N9ZRT; Nov. 27, 2002, available on the Internet at http://www.wireservices.com/n9zrt/ila/ila.html.

Unpublished U.S. Appl. No. 11/867,046, filed Oct. 4, 2007 by Daniel Tam et al., titled "Multiband Current Probe Fed Antenna."

Michael Stewart; The Ship as Antenna; Military Information Technology Online Archives, vol. 8, Issue 10, Dec. 22, 2004.

John H. Meloling, James H. Schukantz Jr., & Joseph Fischer; A Transmit Mast-Clamp Current Probe for Shipboard HF Communications; IEEE 0-7803-8883-6/05, pp. 17-20, 2005.

Fayad, H.; Record, P.; Broadband Liquid Antenna, Electronics Letters, vol. 42, Issue 3, Feb. 2, 2006 pp. 133-134.

Ewananovil Paraschakis, Hazem Fayad Paul Record; Ionic Liquid Antenna; Small Antennas and Novel MetaMaterials pp. 252-254, IEEE, 0-7803-8842-9/05/S, 2005.

Unpublished U.S. Appl. No. 12/119,302, filed May 12, 2008 by Daniel Tam, titled "Electrolytic Fluid Antenna."

Unpublished U.S. Appl. 12/390,868, filed Feb. 23, 2009 by Vincent Dinh et al., titled "Liquid Antennas."

* cited by examiner

*Primary Examiner* — Jacob Y Choi
*Assistant Examiner* — Hasan Islam
(74) *Attorney, Agent, or Firm* — Kyle Eppele; J. Eric Anderson

(57) ABSTRACT

An antenna comprising a first current probe having an aperture; a first transceiver operatively coupled to the current probe; a signal enhancer disposed approximately inside the aperture, wherein the signal enhancer comprises an inlet, a first outlet, and a housing having an internal volume, and wherein the outer dimensions of the housing are nearly equivalent to the dimensions of the aperture; a pump configured to pump electrolytic fluid through the internal volume via the inlet and the first outlet; and a first nozzle hydraulically coupled to the first outlet so that when electrolytic fluid is pumped through the internal volume the electrolytic fluid exits the first nozzle in a stream.

20 Claims, 15 Drawing Sheets

ELECTROLYTIC FLUID ANTENNA WITH SIGNAL ENHANCER

FEDERALLY-SPONSORED RESEARCH AND DEVELOPMENT

This invention is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil. Reference Navy Case Number 99933.

BACKGROUND OF THE INVENTION

With increasing numbers of wireless communications systems available today, more and more antennas are required to support them. In many situations the available real estate for placement of antennas is limited. For example, the area available on building rooftops, and exterior surfaces of automobiles, aircraft, and sea craft, which often serve as antenna placement locations, is particularly limited, especially in scenarios where multiple antennas are desired.

BRIEF DESCRIPTION OF THE DRAWINGS

Throughout the several views, like elements are referenced using like references. The elements in the figures are not drawn to scale.

DETAILED DESCRIPTION OF EMBODIMENTS

Figure 1:
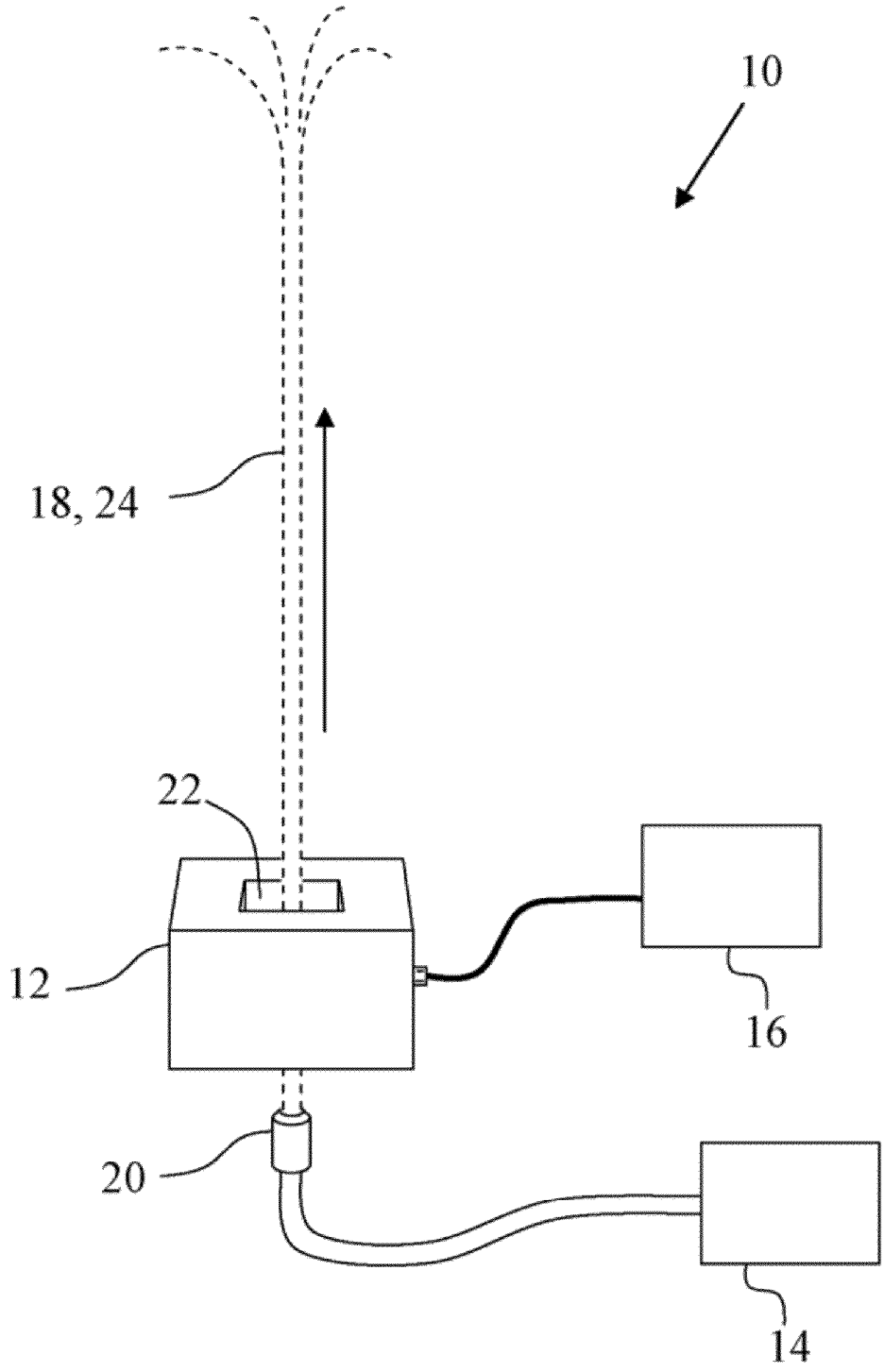
FIG. 1 is a perspective view of an electrolytic fluid antenna.

FIG. 1 shows an embodiment of an electrolytic fluid antenna 10 that comprises a a first current probe 12; a pump 14, and a first transceiver 16. The pump 14 is configured to pump electrolytic fluid 18 out a nozzle 20 and through an aperture 22 in the first current probe 12. The first transceiver

16 is operatively coupled to the current probe 12. Pumping the electrolytic fluid 18 out the nozzle 20 and through the aperture 22 creates a continuous stream 24 that functions as the antenna element thereby, effectively creating an antenna capable of receiving and/or transmitting electromagnetic signals. The electrical length of the electrolytic fluid antenna 10 may be varied continuously by pumping electrolytic fluid 18 high or low enough to get any desired wavelength.

Regarding current probe antennas in general, the antenna voltage is the product of the effective length of the antenna times the incident electric field. An incoming radio frequency (RF) signal may be considered as the incident electric field. The antenna voltage divided by the self-impedance of the antenna governs the antenna current. The movement of the antenna current generates the H magnetic field, which is picked up by the current probe. The magnetic flux density, or B field, in the current probe is generated by the H field and amplified by the permeability $\mu$, of the ferrite core of the current probe. The magnetic flux $\Phi$ in the ferrite core is produced by the cross section of the ferrite core and the B field. The changing magnetic flux $\Phi$ produces the voltage output by the one-turn loop on the ferrite core.

The electrolytic fluid 18 utilized in the electrolytic fluid antenna 10 may be any electrolytic fluid with an electrical conductivity of at least approximately 5 Siemens per meter. A suitable example of the electrolytic fluid 18 is seawater. The electric currents in seawater are flows of electrically charged atoms (sodium ions). When seawater is used in the electrolytic fluid antenna 10, the movement of the sodium ions in the stream 24 allows electric current conduction for signal reception and transmission. The length and diameter of the stream 24 determine the impedance of the electrolytic fluid antenna 10. The length determines the frequency of the electrolytic fluid antenna 10 and the thickness of the diameter of the stream 24 determines the bandwidth of the electrolytic fluid antenna 10. Although reference is made to the diameter of the stream 24, it is to be understood that the cross-section of the stream 24 need not be circular, but that the stream 24 may have any cross-sectional shape.

The first current probe 12 comprises a ferrite core and a nonmagnetic housing. Although the housing of the first current probe 12 is shown in FIG. 1 as having a rectangular shape, it is to be understood that the housing is not limited to rectangular shapes. The housing may be made of any nonmagnetic material. The housing and internal ferrite core of the first current probe 12 may have the shape of a toroid or any other shape that is topologically equivalent. The first current probe 12 may be designed to transmit and/or receive in any given operating band. For example, an embodiment of the electrolytic fluid antenna 10 may comprise a first current probe 12 designed to transmit and receive in the High Frequency (HF) range (2-100 MHz). The current probe 12 may be positioned with respect to the stream 24 such that the current probe 12's voltage standing wave ratio (VSWR) is less than or equal to approximately its operating frequency range VSWR requirement of the first transceiver 16. For example, the current probe 12's VSWR may be less than or equal to approximately 3:1.

Figure 2:
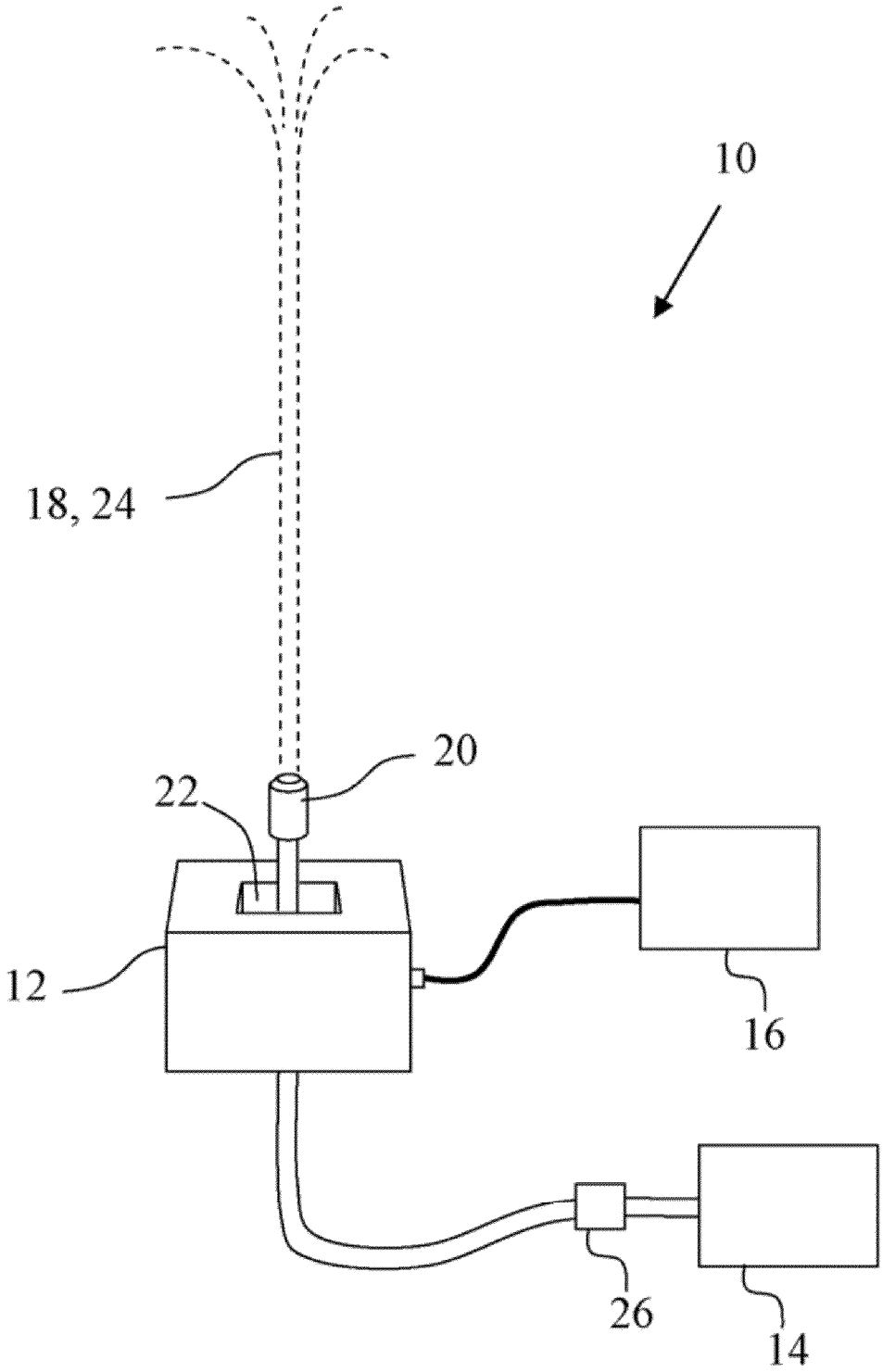
FIG. 2 is a perspective view of an embodiment of the electrolytic fluid antenna including a pressure regulator.

FIG. 2 shows another embodiment of the electrolytic fluid antenna 10 further comprising a pressure regulator 26 operatively coupled to the pump 14. The pressure regulator 26 is configured to alter the pressure of the electrolytic fluid 18 between the pump 14 and the nozzle 20; thereby altering the length of the stream 24 of electrolytic fluid 18. Different stream 24 lengths produce different electrical lengths that cause different resonant frequency responses of the electrolytic fluid antenna 10. The size and shape of the nozzle 20 may also be altered to change the size and shape of the stream 24. The nozzle 20 may be positioned in any manner that allows the electrolytic fluid 18 to pass through the aperture 22. For example, the embodiment of the electrolytic fluid antenna 10 shown in FIG. 1 shows the nozzle 20 below the current probe 12. FIG. 2 shows another example embodiment of the electrolytic fluid antenna 10 with the nozzle 20 above the current probe 12. The first current probe 12 may be positioned in any desired place along the stream 24. The nozzle 20 may be configured to direct the stream 24 in any direction. For example, the nozzle 20 may be configured to direct the stream 24 of electrolytic fluid 18 in a direction that is approximately opposite to Earth's gravitational field, as shown in FIGS. 1-5 and 8. Different stream 24 directions will produce different electrolytic fluid antenna 10 polarizations.

Figure 3:
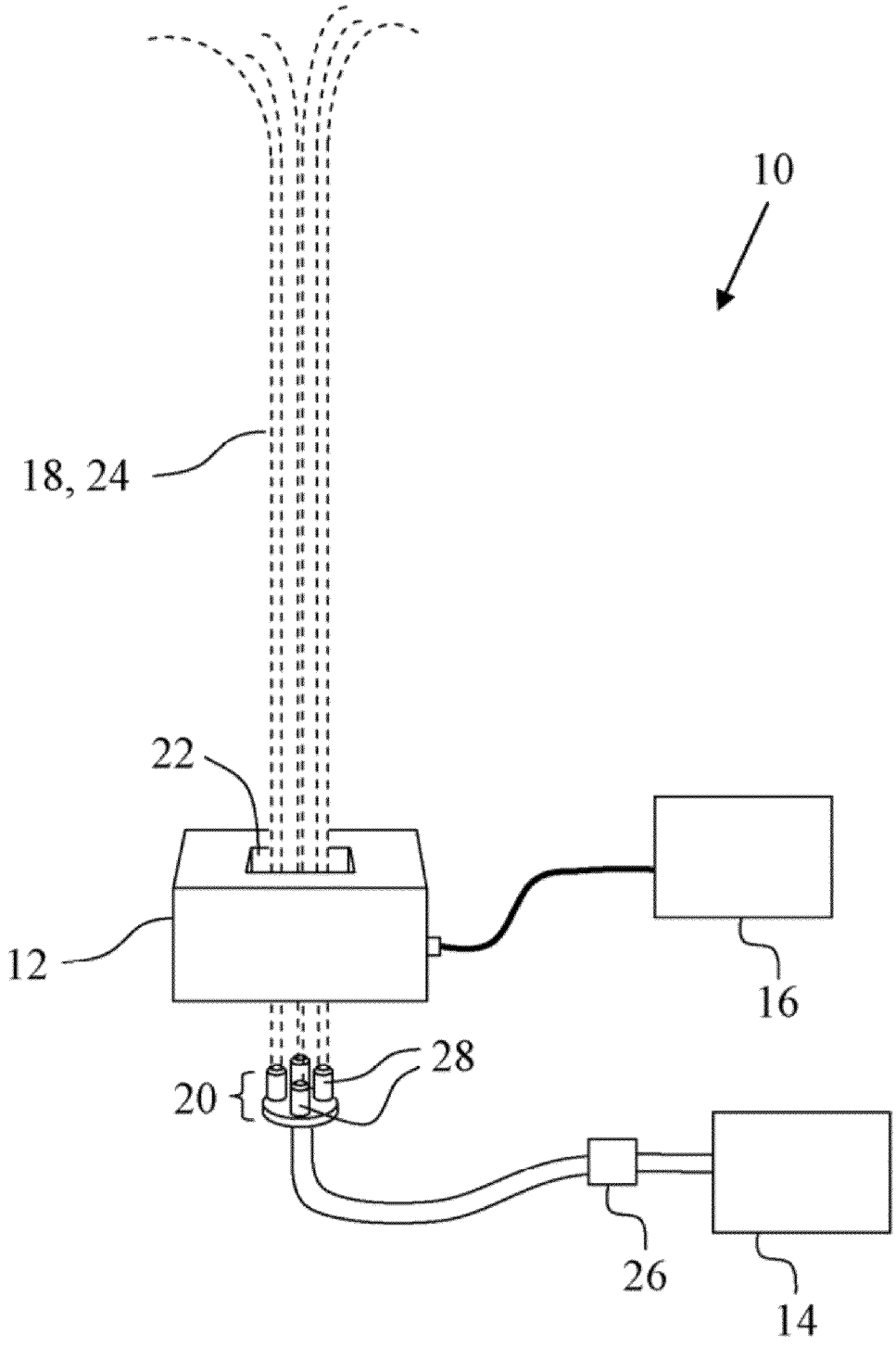
FIG. 3 is a perspective view of another embodiment of the electrolytic fluid antenna including a multi-head nozzle.

FIG. 3 shows an embodiment of the electrolytic fluid antenna 10 where the nozzle 20 comprises multiple heads 28. In the embodiment shown in FIG. 3, the multiple heads 28 are arranged such that the stream 24 is comprised of multiple sub-streams. The heads 28 may be arranged in any configuration. For example, the heads 28 may be arranged in a concentric ring configuration. The nozzle 20 may have any desired number of heads 28.

Figure 4:
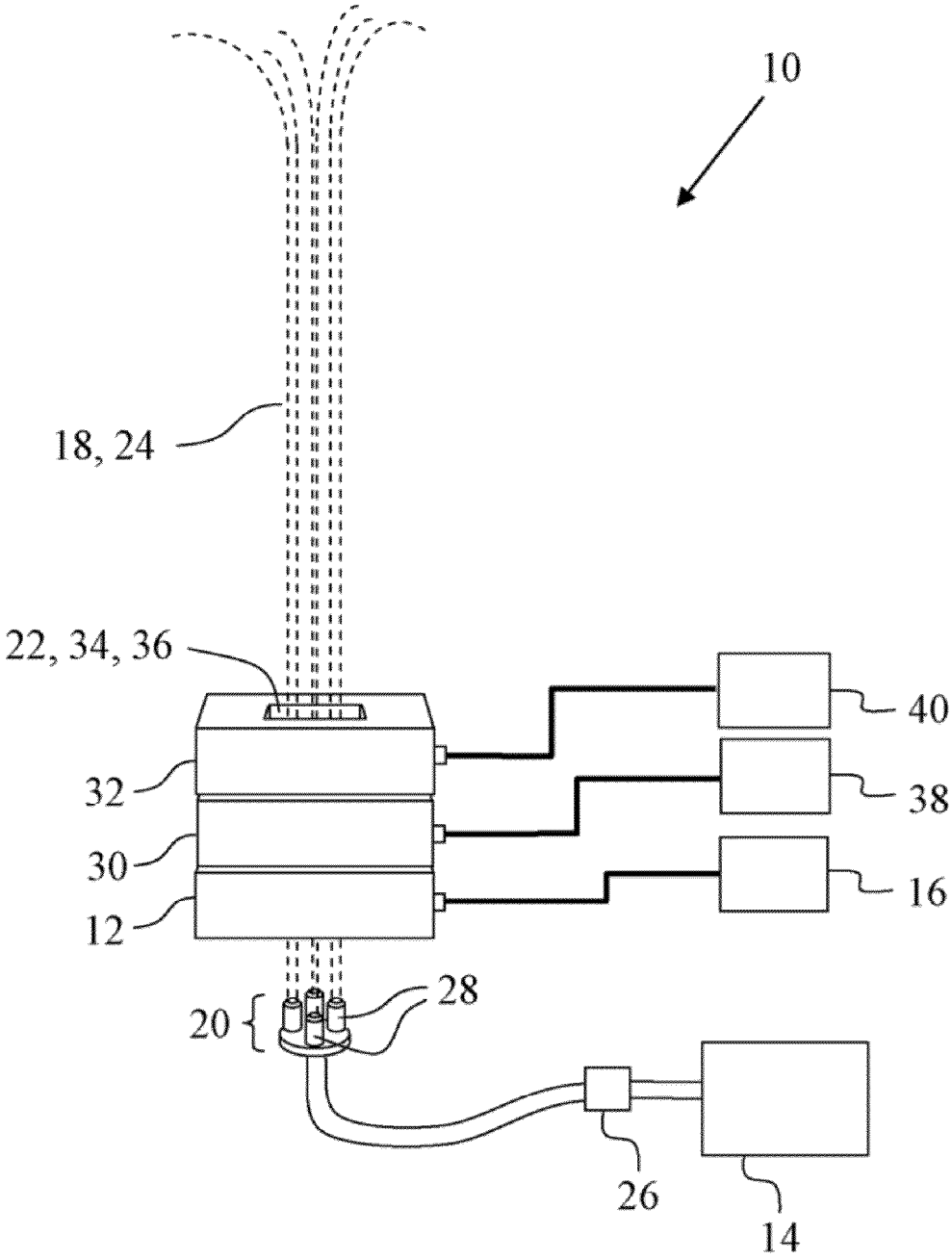
FIG. 4 shows a multi-band embodiment of the electrolytic fluid antenna.

FIG. 4 shows another embodiment of the electrolytic fluid antenna 10 with second and third current probes 30 and 32 respectively. The second and third current probes 30 and 32 each have an aperture 34 and 36 respectively. The first, second, and third apertures 22, 34, and 36 are approximately aligned with each other to allow the electrolytic fluid 18 to pass there through. As shown in FIG. 4., current probes 12, 30, and 32 are operatively coupled to respective transceivers 16, 38, and 40. Each current probe and corresponding transceiver combination may be configured to receive and transmit in a substantially different frequency band than the other current probe and transceiver combinations. For example, the first current probe 12 and the first transceiver 16 may be configured to transmit and receive electromagnetic signals within a high frequency (HF) band, the second current probe 30 and the second transceiver 38 may be configured to transmit and receive electromagnetic signals within a very high frequency (VHF) band, and the third current probe 32 and the third transceiver 40 may be configured to transmit and receive electromagnetic signals within an ultra high frequency (UHF) band.

Figure 5:
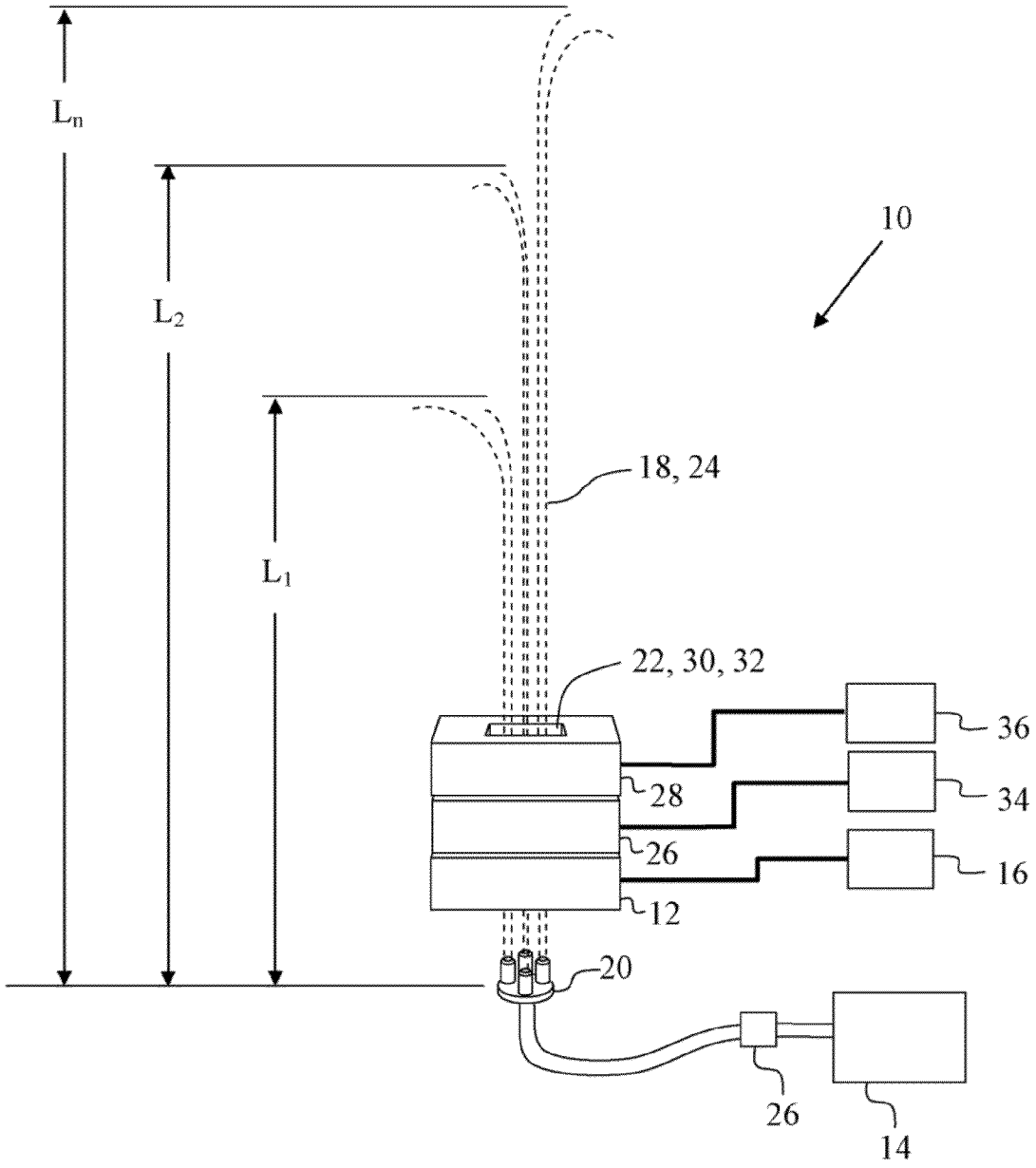
FIG. 5 shows an embodiment of the multi-band electrolytic fluid antenna with varying electrolytic fluid lengths.

FIG. 5 shows stream 24 with multiple sub-streams of different lengths $L_1$-$L_n$, where n is an index. Different sub-stream lengths produce different electrical lengths that cause different resonant frequency responses. For example, first, second, and third sub-stream lengths can be set to provide resonant frequency responses in the HF, VHF, and UHF bands respectively. The different sub-streams of stream 24 may be set to any desired length L. The different sub-stream lengths may be produced by altering the size and shape of the different heads 28 or by altering the pressure of the electrolytic fluid 18 at each of the heads 28. The resonant frequency response of the electrolytic fluid antenna 10 may be altered in real-time simply by altering the length of the stream 24 or one of its constituent sub-streams.

Figure 6:
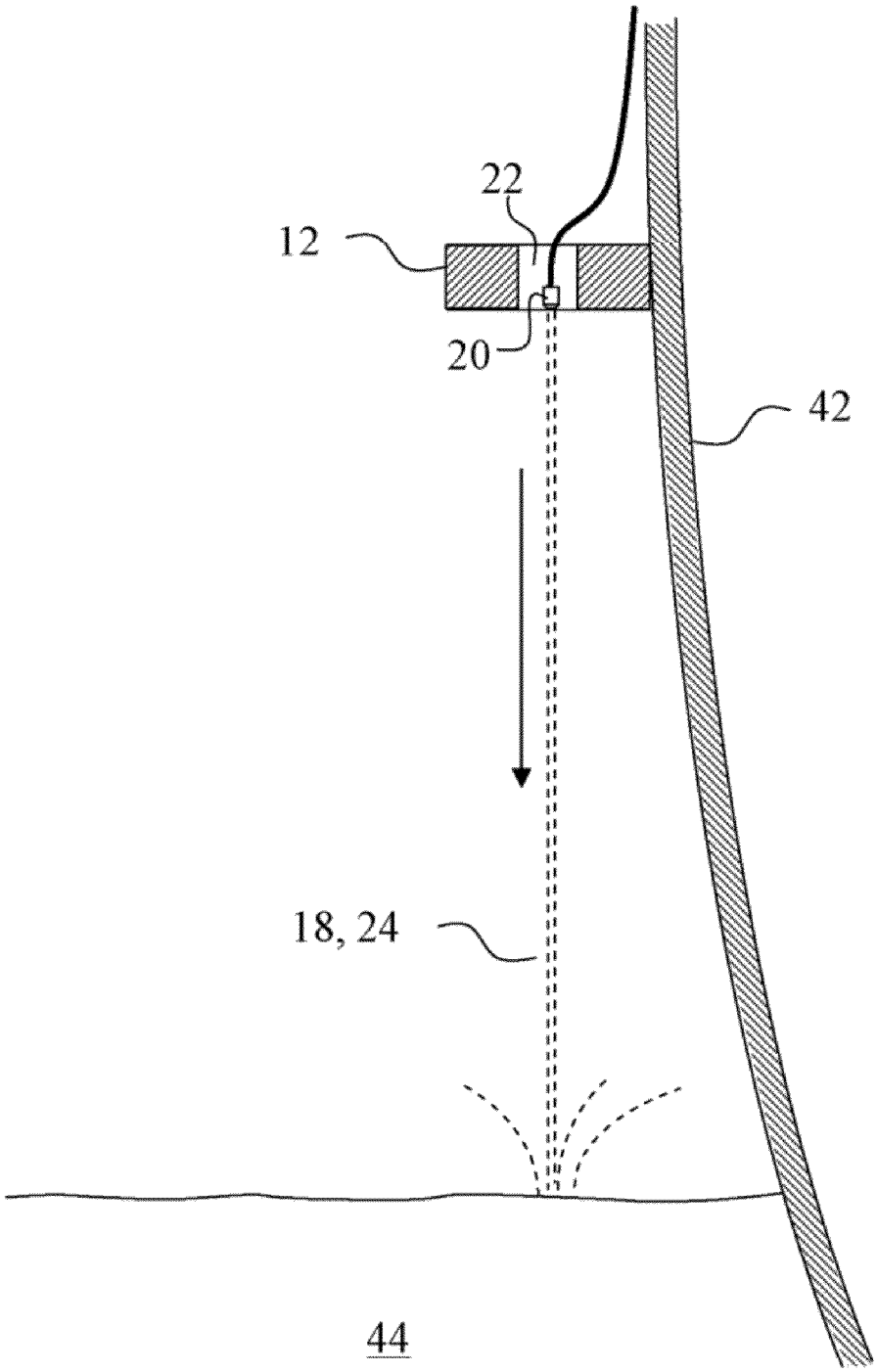
FIG. 6 is a cross-sectional view of the electrolytic fluid antenna.
Figure 7:
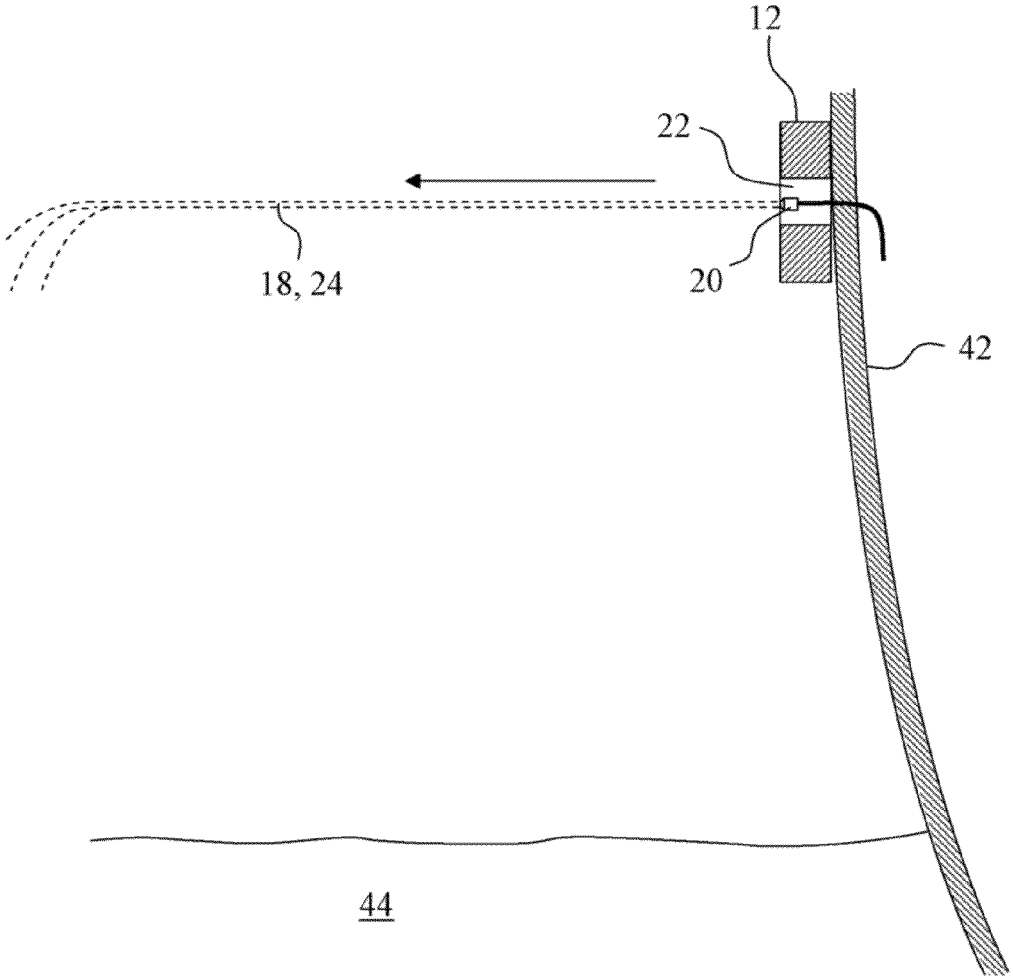
FIG. 7 is a cross-sectional view of an alternate orientation of the electrolytic fluid antenna.
Figure 8:
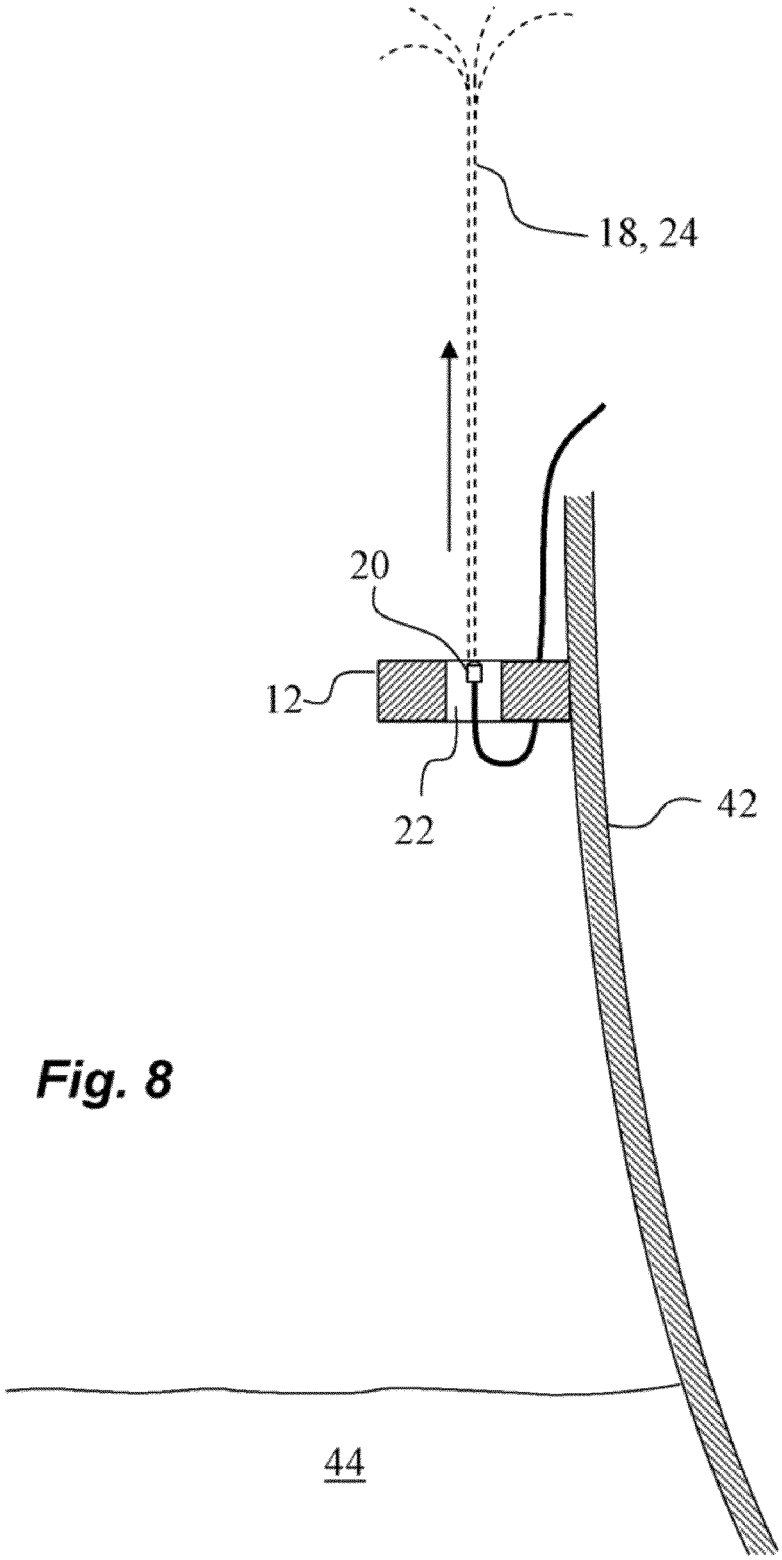
FIG. 8 is a cross-sectional view of an alternate orientation of the electrolytic fluid antenna.

FIGS. 6-8 are cross-sectional views of the electrolytic fluid antenna 10 showing the current probe 12 mounted to the side of a ship 42 afloat in a body of water 44. In the embodiment shown in FIG. 6, the nozzle 20 is positioned inside the aperture 22 and the stream 24 is directed downward, i.e. in the same direction as Earth's gravitational field. For clarity purposes, other elements described previously, such as the pump 14 and the first receiver 16 are not depicted in FIGS. 6-8. In one embodiment, the water 44 may be seawater that can be pumped by the pump 14 through the aperture 22 and back into the water 44. In the embodiment shown in FIG. 7, the stream 24 is directed outward, i.e. perpendicular to Earth's gravitational field. In the embodiment shown in FIG. 8, the stream 24 is directed upward, i.e. opposite to Earth's gravitational field.

Figure 9:
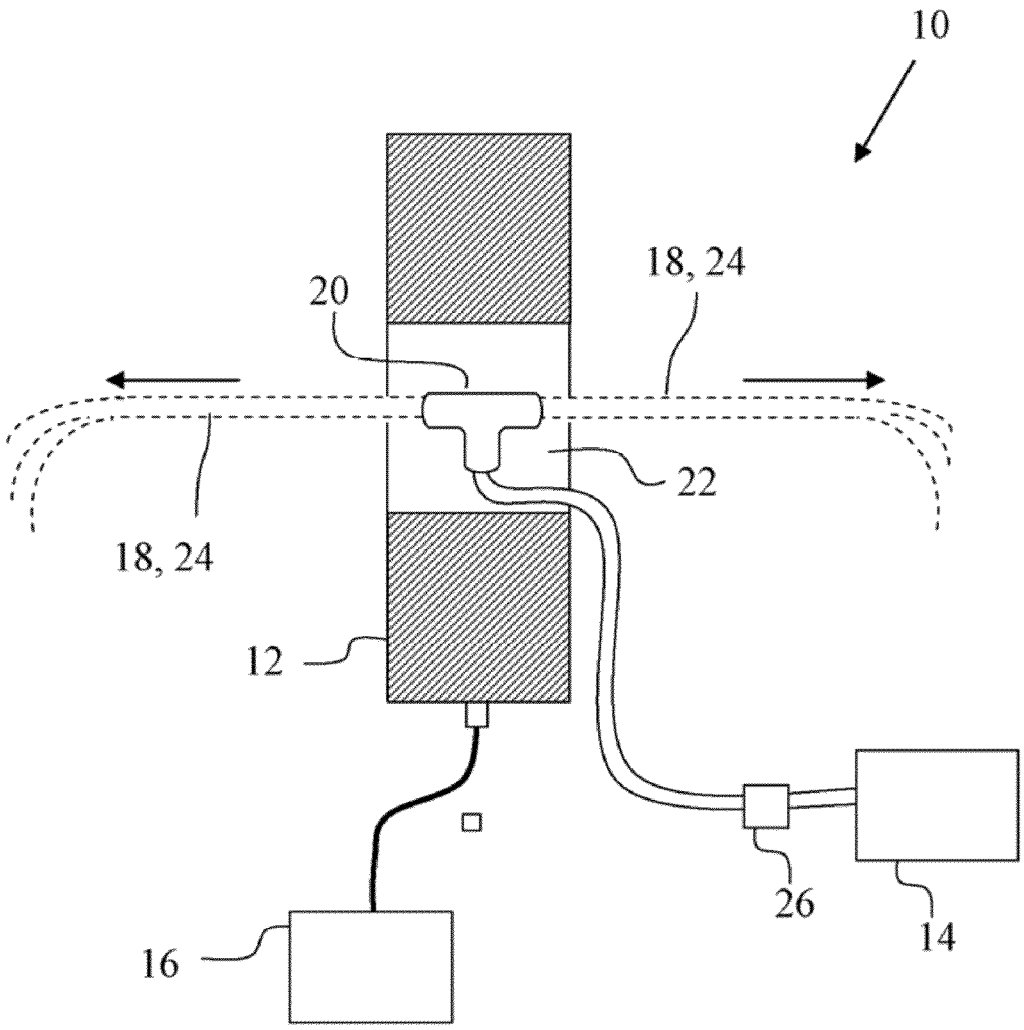
FIG. 9 is a cross-sectional view of a dipole embodiment of the electrolytic fluid antenna.

FIG. 9 is a dipole embodiment of the electrolytic fluid antenna 10 wherein the nozzle 20 is configured to produce two streams 24 of electrolytic fluid 18 both emanate emanating from the current probe 12. A cross-section of the current probe 12 is shown so that the aperture 22 and the nozzle 20 can be clearly seen. In this embodiment, the electrolytic fluid antenna 10 functions as a ½-wavelength dipole antenna.

Figure 10:
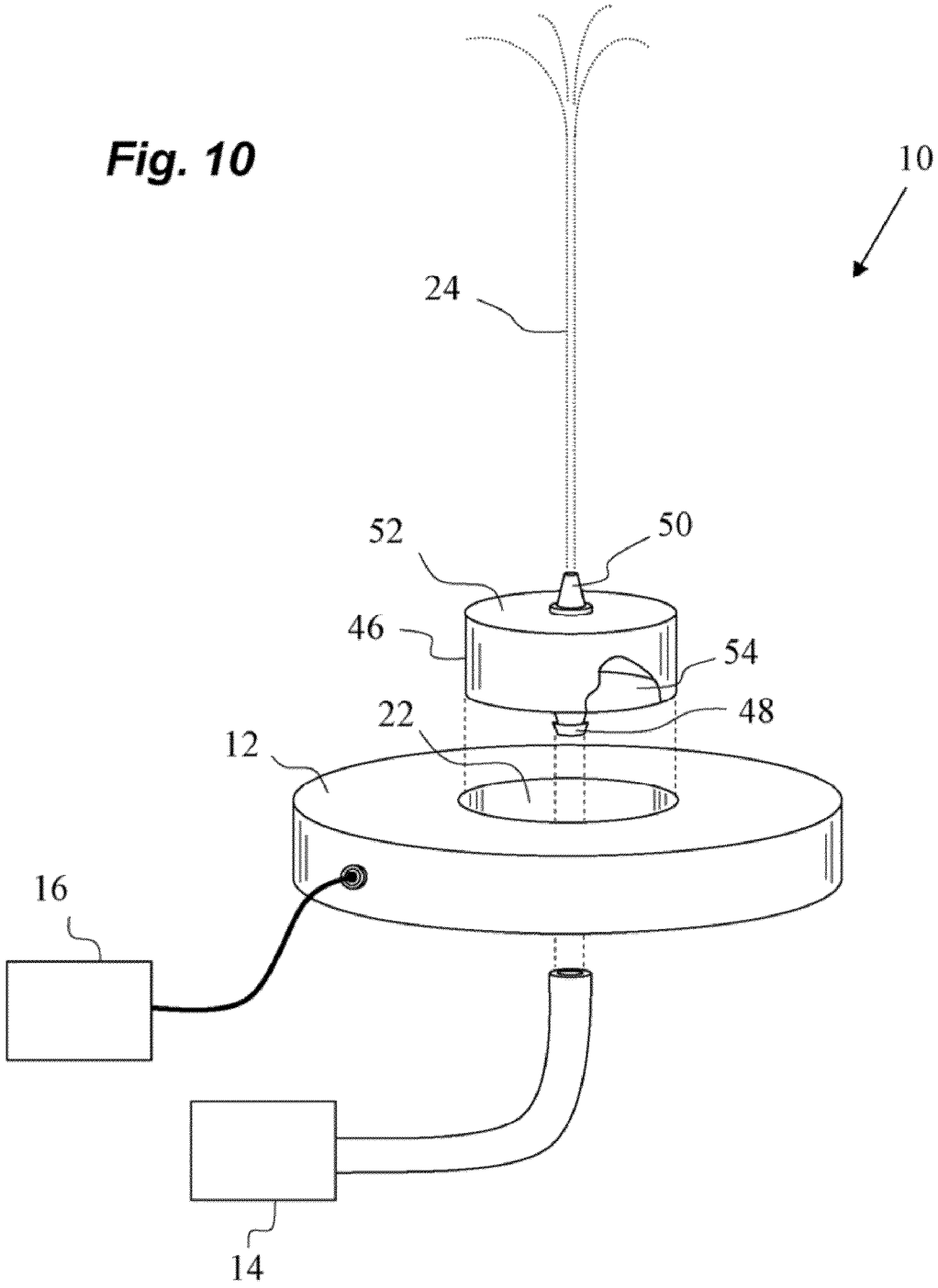
FIG. 10 is an expanded perspective view of the electrolytic fluid antenna with a signal enhancer.

FIG. 10 shows an expanded perspective view of another embodiment of the electrolytic fluid antenna 10. In this embodiment, the electrolytic fluid antenna 10 further comprises a signal enhancer 46 disposed approximately inside the aperture 22 of the first current probe 12, which is operatively coupled to the first transceiver 16. The signal enhancer 46 comprises an inlet 48, a first outlet 50, and a non-conductive housing 52 having an internal volume 54. The housing 52 is shaped so that the housing 52 substantially fills the aperture 22. The pump 14 is hydraulically coupled to the inlet 48. In this embodiment, the pump 14 is configured to pump electrolytic fluid 18 through the internal volume 54 so that the electrolytic fluid 18 fills the internal 54 and then exits the first outlet 50 in a stream 24.

Figure 11:
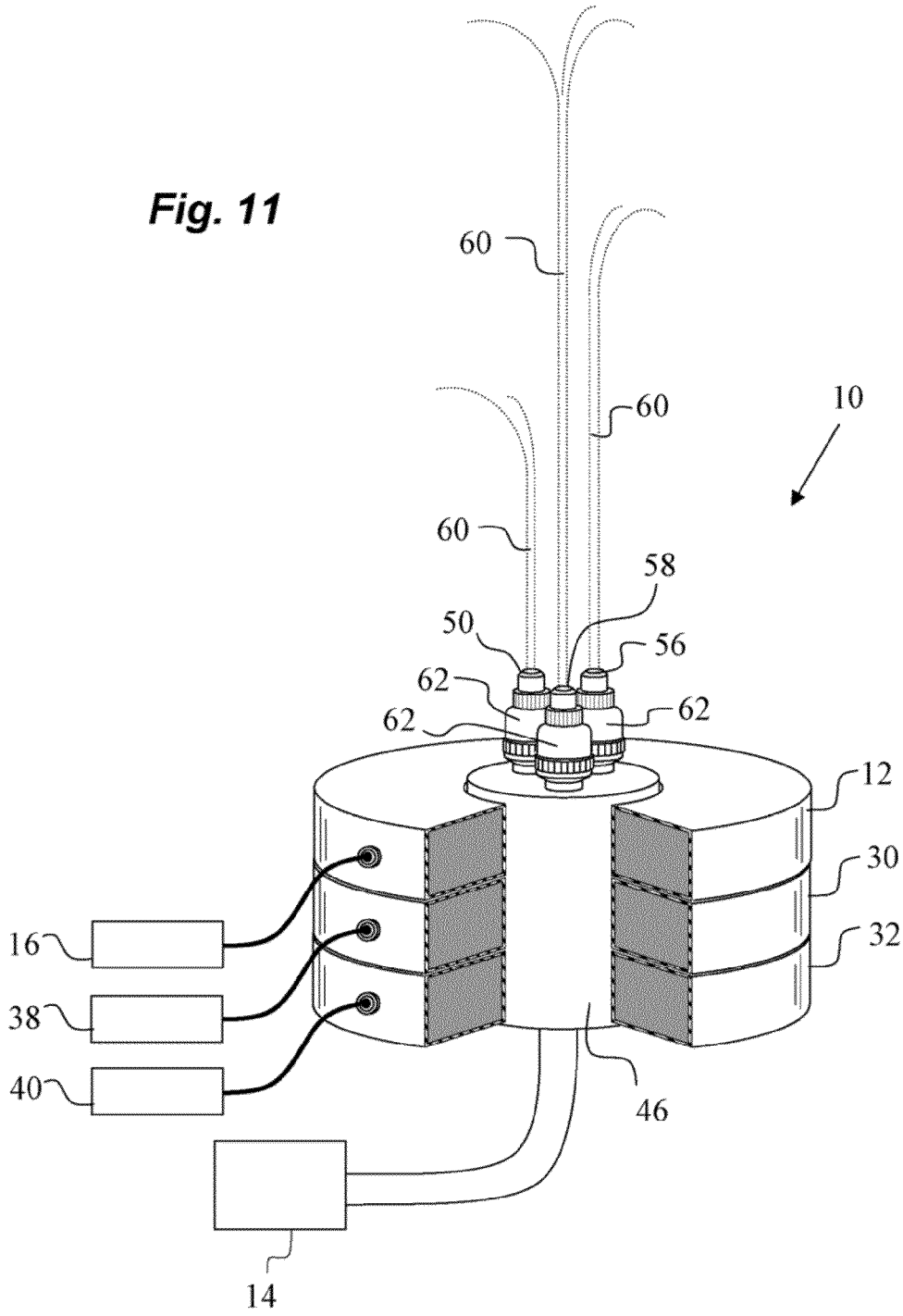
FIG. 11 is an partially cut-away perspective view of a multi-band electrolytic fluid antenna with a signal enhancer.

FIG. 11 shows a partial cut-away perspective view of a multi-band embodiment of the electrolytic fluid antenna 10 comprising first, second, and third current probes 12, 30, and 32, which are aligned with each other and operatively coupled to first, second, and third transceivers 16, 38, and 40 respectively. Each current probe and corresponding transceiver combination is configured to receive and transmit in a substantially different frequency band than the other current probe and transceiver combinations. In the embodiment shown in FIG. 11, the signal enhancer 46 fills the apertures of each of the current probes 12, 30, and 32. In this embodiment, the signal enhancer 46 comprises first, second, and third outlets 50, 56 and 58 respectively. Electrolytic fluid 18 may pumped into the internal volume 54 and out the first, second, and third outlets 50, 56, and 58, such that the stream of electrolytic fluid 24 is comprised of multiple sub-streams 60. Each outlet may further comprise a sub-stream height adjustor 62 capable of adjusting the height of its corresponding sub-stream 60. In this way, each sub stream 60 is individually adjustable. The sub-stream height adjustor 62 may be any device capable of adjusting the height of the corresponding sub-stream 60. A pressure regulator is a non-limiting example of a sub-stream height adjustor 62.

In the embodiment of the electrolytic fluid antenna 10 depicted in FIG. 11, the first current probe 12 and the first transceiver 16 may be configured to transmit and receive electromagnetic signals within a high frequency (HF) band, the second current probe 30 and the second transceiver 38 may be configured to transmit and receive electromagnetic signals within a very high frequency (VHF) band, and the third current probe 32 and the third transceiver 40 may be configured to transmit and receive electromagnetic signals within an ultra high frequency (UHF) band. The height of each of the sub-streams 62 may be adjusted to operate in one of the UHF, VHF, and HF bands, at least one sub-stream 62 set to operate in each band. While the embodiment of the electrolytic fluid antenna 10 shown in FIG. 11 is shown operating in only three bands, it is to be understood that the electrolytic fluid antenna 10 is not limited to a 3-band embodiment, but the electrolytic fluid antenna 10 may comprise any number of current probes, transceivers, and outlets configured to operate in a desired frequency range or ranges.

Figure 12:
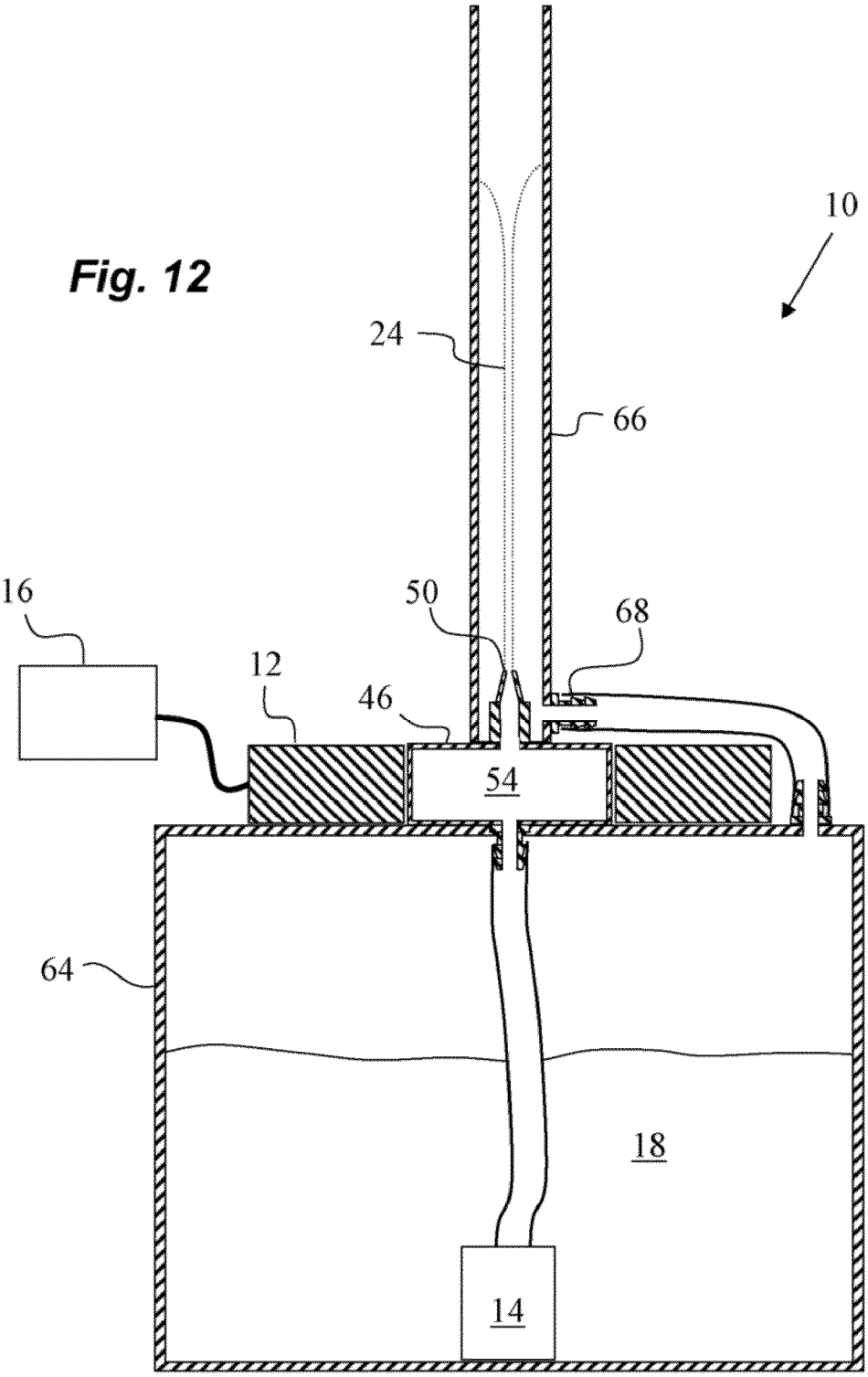
FIG. 12 is an cross-sectional view of another embodiment of the electrolytic fluid antenna.

FIG. 12 shows a cross-sectional view of the electrolytic fluid antenna 10 further comprising a man-portable fluid storage vessel 64 capable of storing the electrolytic fluid 18. In this embodiment the pump 14 pumps the electrolytic fluid 18 from the fluid storage vessel 64 into the internal volume 54 of the signal enhancer 46 and then out the first outlet 50. The first outlet 50 may be enclosed by a tube 66 with a height greater than the stream 24 so that electrolytic fluid 18 falling from the stream 24 is caught by the tube 66 and channeled back into the fluid storage container 64 via a drain 68. The tube 66 may be open or capped at its distal end.

The pump 14 may be any pump capable of generating sufficient head to cause the electrolytic fluid 18 to exit the first outlet in a stream 24. For example, and not by way of limitation, the pump may be battery powered, hard-wired, man-powered, and/or powered by solar cells. The pump 14 may draw electrolytic fluid 18 from the fluid storage vessel 64 or from some other source such as the ocean or other body of water with electrolytic properties.

Figure 13:
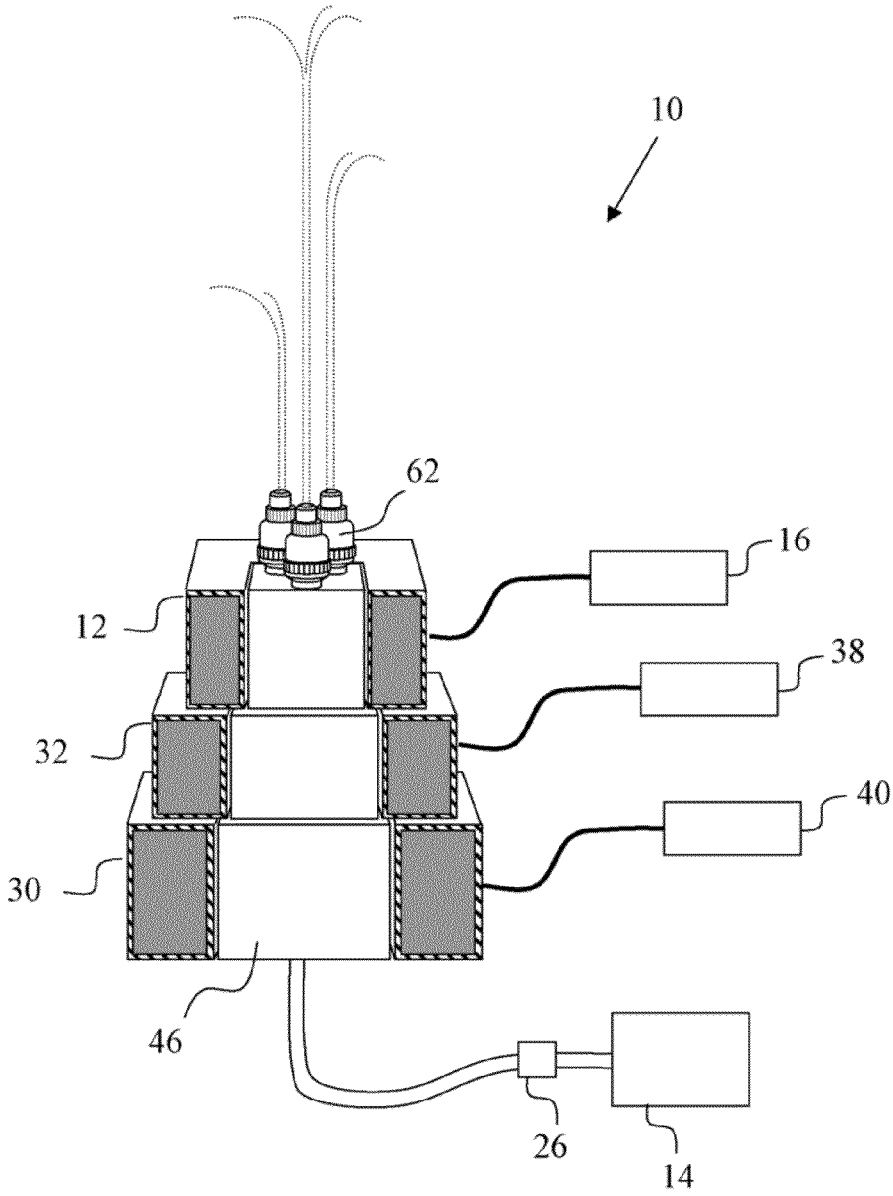
FIG. 13 is a perspective view of another embodiment of the electrolytic fluid antenna.

FIG. 13 shows another embodiment of the multi-band electrolytic fluid antenna 10. This figure shows how the current probes may be various sizes and shapes depending on the desired operating frequency. FIG. 13 also shows that the signal enhancer 46 may be various sizes and shapes in order to conform to the apertures of the current probes.

Figure 14:
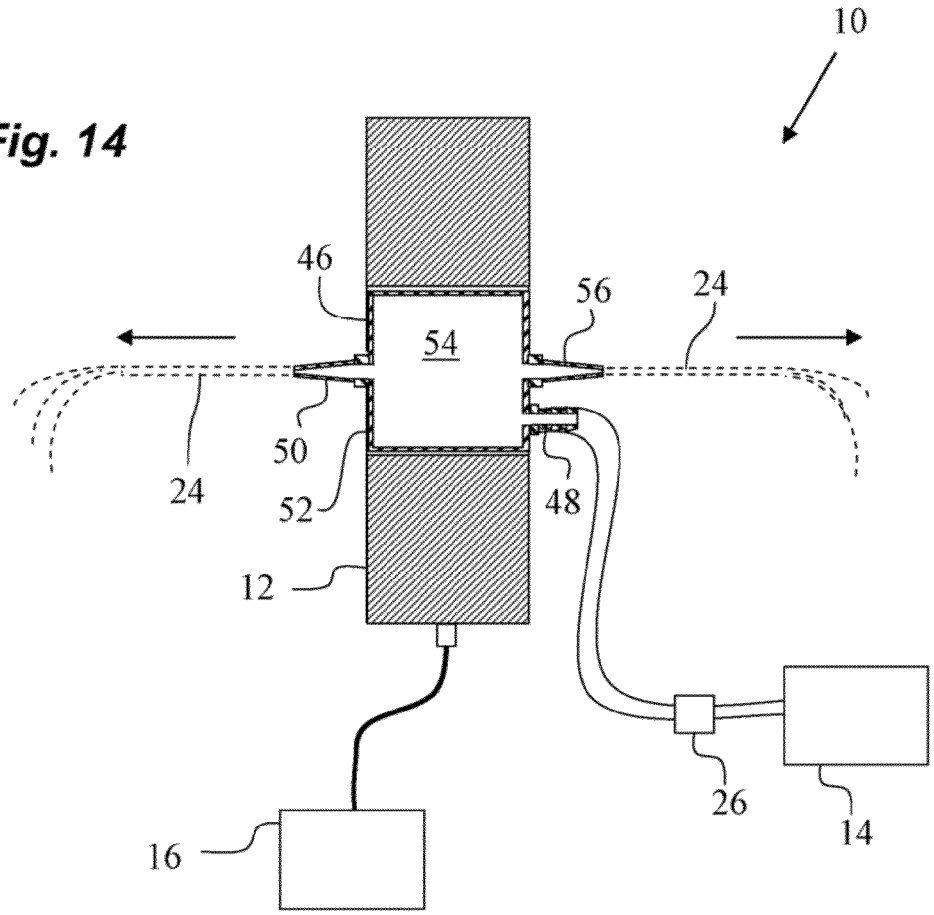
FIG. 14 is a cross-sectional view of another dipole embodiment of the electrolytic fluid antenna.

FIG. 14 is a cross-sectional view of a dipole embodiment of the electrolytic fluid antenna 10 with a signal enhancer 46. As shown in the figure, in this embodiment, the signal enhancer 46 has a first outlet 50 connected to one side of the housing 52 and a second outlet 56 connected to the opposite side of the housing 52. The electrolytic fluid 18 enters the internal volume 54 through the inlet 48 and then exits approximately simultaneously from the first and second outlets 50 and 56 effectively creating a dipole antenna.

Figure 15:
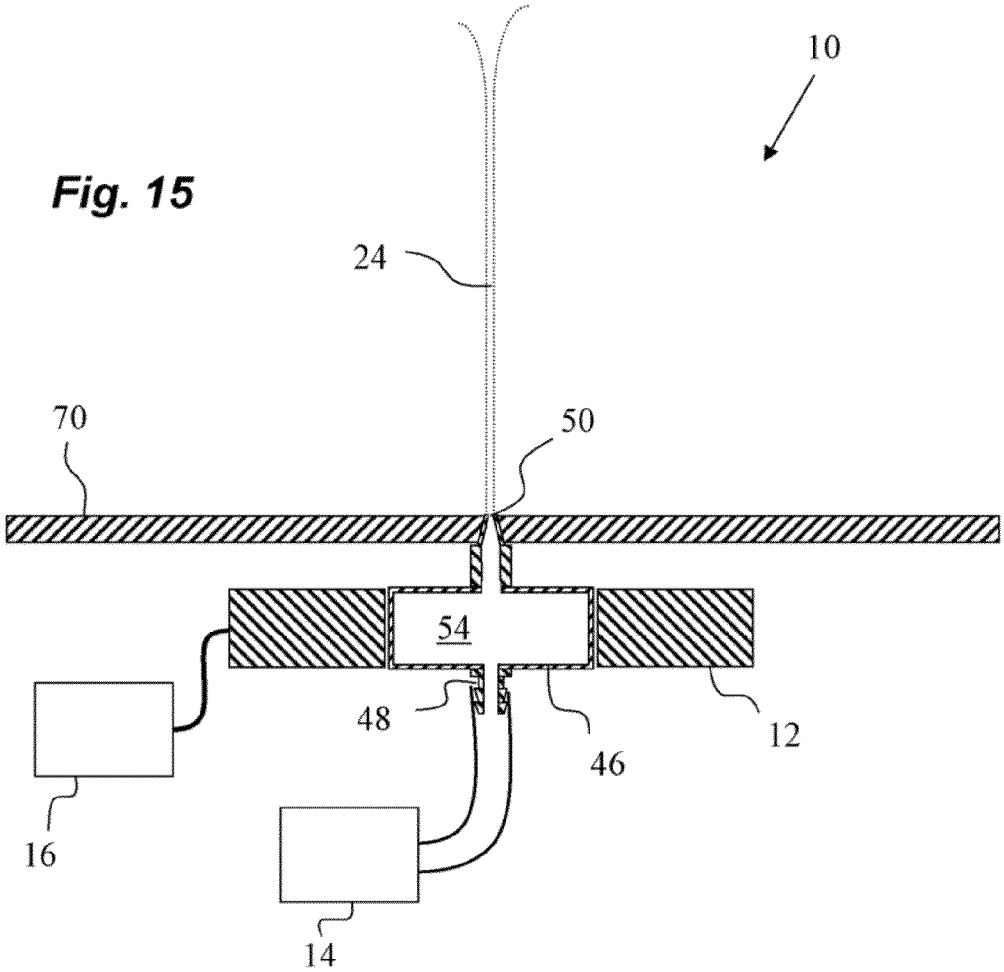
FIG. 15 is a cross-sectional view of an embodiment of the electrolytic fluid antenna mounted below the deck of a ship.

FIG. 15 is a cross-sectional view of another embodiment of the electrolytic fluid antenna 10, wherein the electrolytic fluid antenna 10 is mounted to a ship's deck 70 such that the first outlet 50 is flush mounted to the deck 70 and all the other components of the electrolytic fluid antenna 10 are below the deck 70. Multiple current probes, transceivers, and outlets may also be used in this embodiment to create a multi-band antenna in the ship's deck 70 as well as the single-band antenna shown.

From the above description of the electrolytic fluid antenna 10, it is manifest that various techniques may be used for implementing the concepts of electrolytic fluid antenna 10 without departing from its scope. The described embodiments are to be considered in all respects as illustrative and not restrictive. It should also be understood that the electrolytic fluid antenna 10 is not limited to the particular embodiments described herein, but is capable of many embodiments without departing from the scope of the claims.

I claim:

1. An antenna comprising:

a first current probe having an aperture;

a first transceiver operatively coupled to the current probe;

a signal enhancer disposed approximately inside the aperture, wherein the signal enhancer comprises an inlet, a first outlet, and a non-conductive housing having an internal volume, and wherein the housing substantially fills the aperture; and a pump hydraulically coupled to the inlet and configured to pump electrolytic fluid through the internal volume so that the electrolytic fluid exits the first outlet in a free-standing stream.

2. The antenna of claim 1, further comprising a pressure regulator operatively coupled to the pump, wherein the pressure regulator is configured to alter the height of the stream by adjusting the pressure of the electrolytic fluid between the pump and the inlet.

3. The antenna of claim 1, wherein the signal enhancer further comprises second and third outlets such that the stream of electrolytic fluid is comprised of multiple sub-streams, wherein each outlet further comprises a sub-stream height adjustor.

4. The antenna of claim 3, further comprising:

second and third current probes, wherein the second and third current probes each have an aperture, and wherein the apertures of each current probe are approximately aligned with each other;

second and third transceivers, wherein the second and third transceivers are operatively coupled to the second and third current probes respectively; and wherein the signal enhancer extends into the apertures of the second and third current probes and wherein each current probe and corresponding transceiver combination is configured to receive and transmit in a substantially different frequency band than the other current probe and transceiver combinations.

5. The antenna of claim 4, wherein the first current probe and the first transceiver are configured to transmit and receive electromagnetic signals within a high frequency (HF) band, the second current probe and the second transceiver are configured to transmit and receive electromagnetic signals within a very high frequency (VHF) band, and the third current probe and the third transceiver are configured to transmit and receive electromagnetic signals within an ultra high frequency (UHF) band, and wherein the heights of the sub-streams are set for operation in the UHF, VHF, and HF bands, at least one sub-stream per band.

6. The antenna of claim 1, further comprising a man-portable fluid storage vessel capable of storing the electrolytic fluid, wherein the pump draws the electrolytic fluid from the fluid storage vessel.

7. The antenna of claim 6, further comprising a tube having a height greater than the stream, wherein the tube is positioned around the first outlet so as to enclose the stream and wherein the tube further comprises a drain coupled to the fluid storage vessel such that the electrolytic fluid falling from the stream is channeled back into the fluid storage vessel.

8. The antenna of claim 3, wherein the pump is man-powered.

9. The antenna of claim 2, wherein the first outlet is flush mounted to a ship's deck such that all the other components of the antenna are below the deck.

10. The antenna of claim 2, wherein the electrolytic fluid is seawater.

11. The antenna of claim 2, wherein the signal enhancer comprises a second outlet positioned on an opposite side of the housing from the first outlet such that two opposing streams of electrolytic fluid exit from either side of the aperture.

12. A method for providing a transmitting/receiving antenna comprising:

operatively coupling a current probe having an aperture to a transceiver;

positioning a signal enhancer inside the aperture, wherein the signal enhancer comprises a housing having an internal volume that is substantially similar to the volume defined by the aperture;

pumping a free-standing stream of electrolytic fluid through the signal enhancer and out a nozzle to effectively create an antenna.

13. The method of claim 12, wherein the electrolytic fluid is seawater.

14. The method of claim 13, further comprising the step of separating the stream of electrolytic fluid into multiple sub-streams of different heights.

15. The method of claim 12, further comprising altering a resonant frequency response of the antenna by altering the height of the stream.

16. The method of claim 14, further comprising:

mounting multiple current probes, each having an aperture, on top of each other at approximately the base of the stream;

positioning a signal enhancer inside the aperture of each of the current probes, wherein each signal enhancer comprises a housing having an internal volume that is substantially similar to the volume defined by the aperture of the corresponding current probe;

operatively coupling each current probe to a separate transceiver; and configuring each current probe and transceiver combination to receive and transmit electromagnetic signals in a substantially different frequency band than the other current probe and transceiver combinations.

17. The method of claim 16, further comprising the step of adjusting the height of each sub-stream such that each sub-stream causes a resonant frequency response in the frequency band of one of the current probe and transceiver combinations.

18. The method of claim 12, further comprising the step of pumping the electrolytic fluid from a man-portable fluid storage vessel.

19. The method of claim 18, further comprising the step of enclosing the stream with a tube such that the electrolytic fluid falling from the stream is channeled back into the fluid storage vessel.

20. An antenna comprising:

a current probe having an aperture;

a transceiver operatively coupled to the current probe;

a signal enhancer positioned inside the aperture, wherein the signal enhancer comprises an inlet, a nozzle, and an internal volume that is substantially similar to the volume defined by the aperture;

a pump hydraulically coupled to the inlet, wherein the pump is configured to pump electrolytic fluid into the signal enhancer such that the electrolytic fluid exits the nozzle in a free-standing stream; and a pressure regulator operatively coupled to the pump such that the pressure regulator is configured to alter the height of the stream by adjusting the pressure of the electrolytic fluid between the pump and the inlet.

* * * * *